US007547202B2

(12) United States Patent
Knapke

(10) Patent No.: US 7,547,202 B2
(45) Date of Patent: Jun. 16, 2009

(54) SCROLL COMPRESSOR WITH CAPACITY MODULATION

(75) Inventor: Brian J. Knapke, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 11/949,382

(22) Filed: Dec. 3, 2007

(65) Prior Publication Data

US 2008/0138227 A1 Jun. 12, 2008

Related U.S. Application Data

(60) Provisional application No. 60/873,998, filed on Dec. 8, 2006.

(51) Int. Cl.
*F04C 18/00* (2006.01)
*F04C 2/00* (2006.01)

(52) U.S. Cl. ..... 418/55.5; 418/55.4; 418/57; 418/270; 417/213; 417/310

(58) Field of Classification Search ..... 418/55.1–55.6, 418/57, 270; 417/212, 213, 299, 302, 307, 417/310, 440

See application file for complete search history.

(56) References Cited

U.S. PATENT DOCUMENTS 2,921,534 A * 1/1960 Gerhard ..... 418/55.1
4,383,805 A 5/1983 Teegarden et al.
4,441,863 A 4/1984 Hotta et al.
4,462,771 A 7/1984 Teegarden et al.
4,468,178 A 8/1984 Hiraga et al.
4,475,874 A 10/1984 Sato
4,497,615 A 2/1985 Griffith
4,505,651 A 3/1985 Terauchi et al.

(Continued)

FOREIGN PATENT DOCUMENTS

DE 35 14230 A1 10/1986

(Continued)

OTHER PUBLICATIONS

International Search Report dated Jun. 17, 2008 regarding International Application No. PCT/US07/25150.

(Continued)

*Primary Examiner*—Theresa Trieu
(74) *Attorney, Agent, or Firm*—Harness, Dickey & Pierce, P.L.C.

(57) ABSTRACT

A scroll compressor may include a shell, a compression mechanism, and a sealing apparatus. The compression mechanism may be contained within the shell and include a compression member. The compression member may include an aperture extending radially there a surface. The sealing apparatus may be contained within the shell and include a first seal member and an actuator. The first seal member may be pivotally supported relative the compression member and may be movable from a first position wherein a sealing portion of the first seal member is in a sealing engagement with the surface and a second position wherein the sealing portion of the first seal member is displaced radially outwardly from the surface. The actuator may be engaged with the first seal member and configured to displace the first seal member from the first position to the second position.

29 Claims, 5 Drawing Sheets

U.S. PATENT DOCUMENTS

| | | | |
|---|---|---|---|
| 4,514,150 | A | 4/1985 | Hiraga et al. |
| 4,557,675 | A | 12/1985 | Murayama et al. |
| 4,566,863 | A | 1/1986 | Goto et al. |
| 4,642,034 | A | 2/1987 | Terauchi |
| 4,673,340 | A | 6/1987 | Mabe et al. |
| 4,696,630 | A | 9/1987 | Sakata et al. |
| 4,747,756 | A | 5/1988 | Sato et al. |
| 4,767,293 | A | 8/1988 | Caillat et al. |
| 4,818,195 | A | 4/1989 | Murayama et al. |
| 4,846,633 | A | 7/1989 | Suzuki et al. |
| 4,877,382 | A | 10/1989 | Caillat et al. |
| 4,958,993 | A | 9/1990 | Fujio |
| 4,992,032 | A | 2/1991 | Barito et al. |
| 5,074,760 | A | 12/1991 | Hirooka et al. |
| 5,074,761 | A | 12/1991 | Hirooka et al. |
| 5,090,878 | A | 2/1992 | Haller |
| 5,102,316 | A | 4/1992 | Caillat et al. |
| 5,192,195 | A | 3/1993 | Iio et al. |
| 5,236,316 | A | 8/1993 | Iio |
| 5,256,044 | A | 10/1993 | Nieter et al. |
| 5,336,058 | A | 8/1994 | Yokoyama |
| 5,362,211 | A | 11/1994 | Iizuka et al. |
| 5,407,335 | A | 4/1995 | Caillat et al. |
| 5,451,146 | A | 9/1995 | Inagaki et al. |
| 5,551,846 | A | 9/1996 | Taylor et al. |
| 5,562,426 | A | 10/1996 | Watanabe et al. |
| 5,591,014 | A | 1/1997 | Wallis et al. |
| 5,607,288 | A | 3/1997 | Wallis et al. |
| 5,613,841 | A | 3/1997 | Bass et al. |
| 5,678,985 | A | 10/1997 | Brooke et al. |
| 5,890,876 | A | 4/1999 | Suito et al. |
| 6,095,765 | A * | 8/2000 | Khalifa ..... 418/55.1 |
| 6,116,867 | A | 9/2000 | Wallis et al. |
| 6,120,255 | A | 9/2000 | Schumann et al. |
| 6,176,686 | B1 | 1/2001 | Wallis et al. |
| 6,821,092 | B1 * | 11/2004 | Gehret et al. ..... 417/213 |
| 7,335,004 | B2 * | 2/2008 | Lee et al. ..... 418/55.1 |
| 2006/0280627 | A1 | 12/2006 | Jayanth |

FOREIGN PATENT DOCUMENTS

| | | | |
|---|---|---|---|
| EP | 0060140 | A1 | 9/1982 |
| EP | 0174516 | A1 | 3/1986 |
| EP | 0681105 | A2 | 11/1995 |
| EP | 0747597 | A2 | 12/1996 |
| JP | 59-211781 | | 11/1984 |
| JP | 3-202691 | | 9/1991 |

OTHER PUBLICATIONS

Written Opinion of the International Searching Authority dated May 26, 2008 regarding International Application No. PCT/US07/25150.

* cited by examiner

SCROLL COMPRESSOR WITH CAPACITY MODULATION

CROSS-REFERENCE TO RELATED APPLICATIONS

This application claims the benefit of U.S. Provisional Application No. 60/873,998, filed on Dec. 8, 2006. The disclosure of the above application is incorporated herein by reference.

FIELD

The present disclosure relates to capacity modulation systems, and more specifically to capacity modulation systems for scroll compressors.

BACKGROUND AND SUMMARY

The statements in this section merely provide background information related to the present disclosure and may not constitute prior art.

Scroll compressor capacity modulation devices currently include a scroll member having a leak path that is selectively sealed by a sealing member. Movement of the sealing member between sealed and unsealed conditions often involves relative motion between the sealing member and the scroll member, wherein the sealing member is rotated about the circumference of the scroll member. This rotation may result in friction between the sealing member and the scroll member as the sealing member is moved between positions, resulting in wear on the sealing member. This wear may degrade the sealing member's ability to seal the leak path in the sealed position, resulting in an undesired reduction in compressor capacity.

According to the present disclosure, a scroll compressor may include a shell, a compression mechanism, and a sealing apparatus. The compression mechanism may be contained within the shell and include a compression member. The compression member may include an aperture extending radially through a surface. The sealing apparatus may be contained within the shell and include a first seal member and an actuator. The first seal member may be pivotally supported relative the compression member and may be movable from a first position wherein a sealing portion of the first seal member is in a sealing engagement with the surface and a second position wherein the sealing portion of the first seal member is displaced radially outwardly from the surface. The actuator may be engaged with the first seal member and configured to displace the first seal member from the first position to the second position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Figure 1:
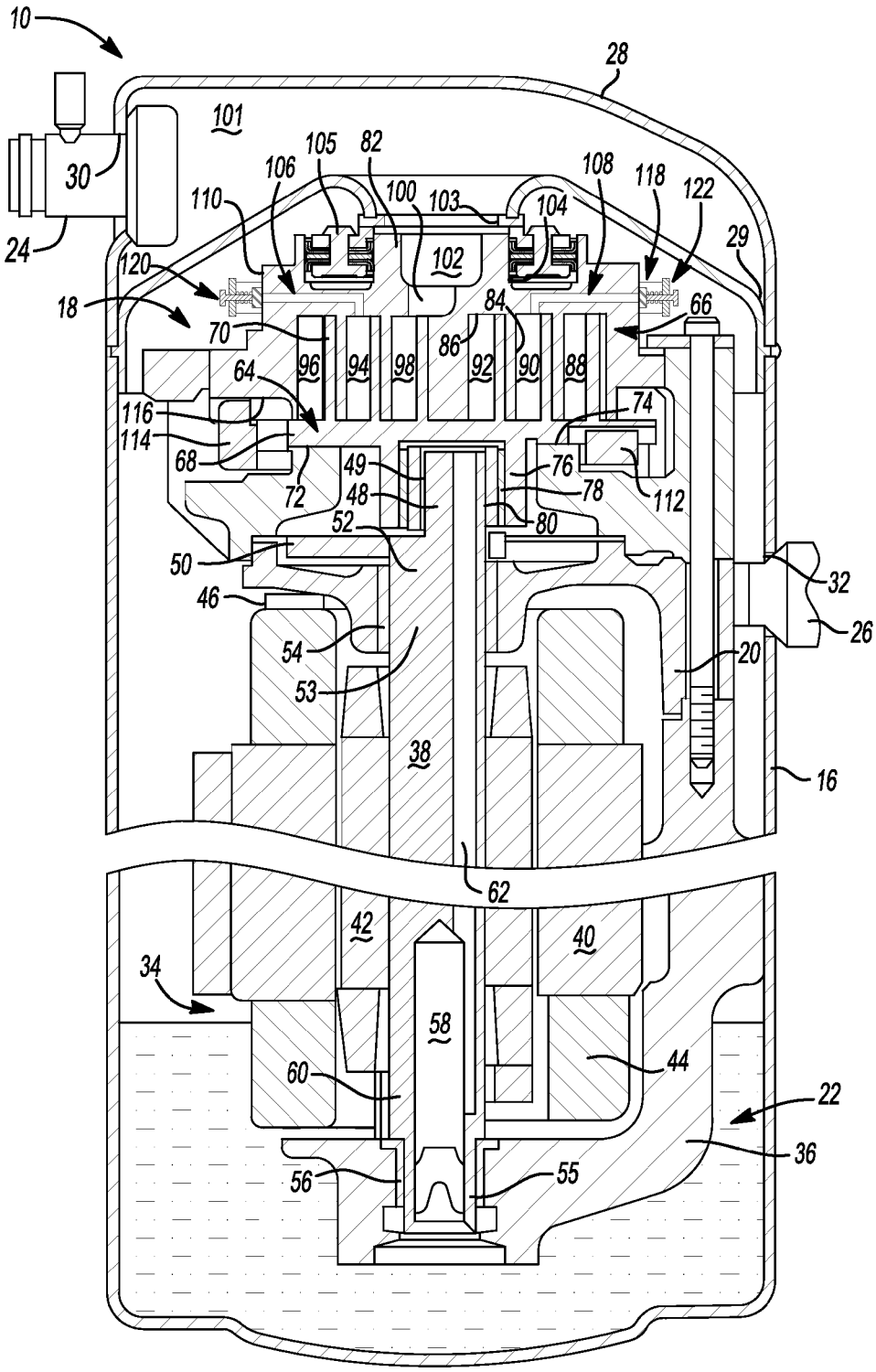
FIG. 1 is a section view of a compressor according to the present disclosure.
Figure 2:
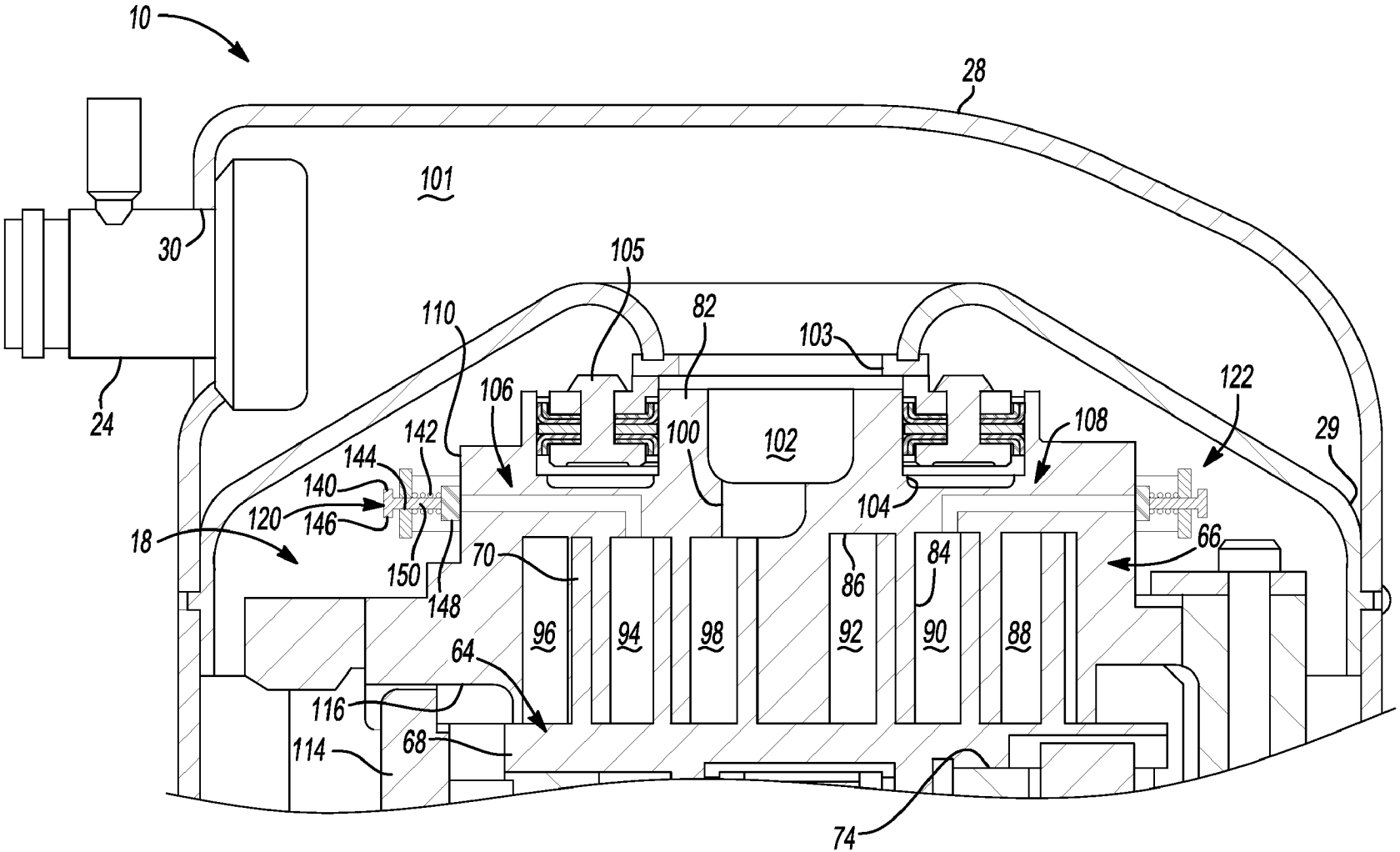
FIG. 2 is a fragmentary section view of the compressor of FIG. 1.
Figure 3:
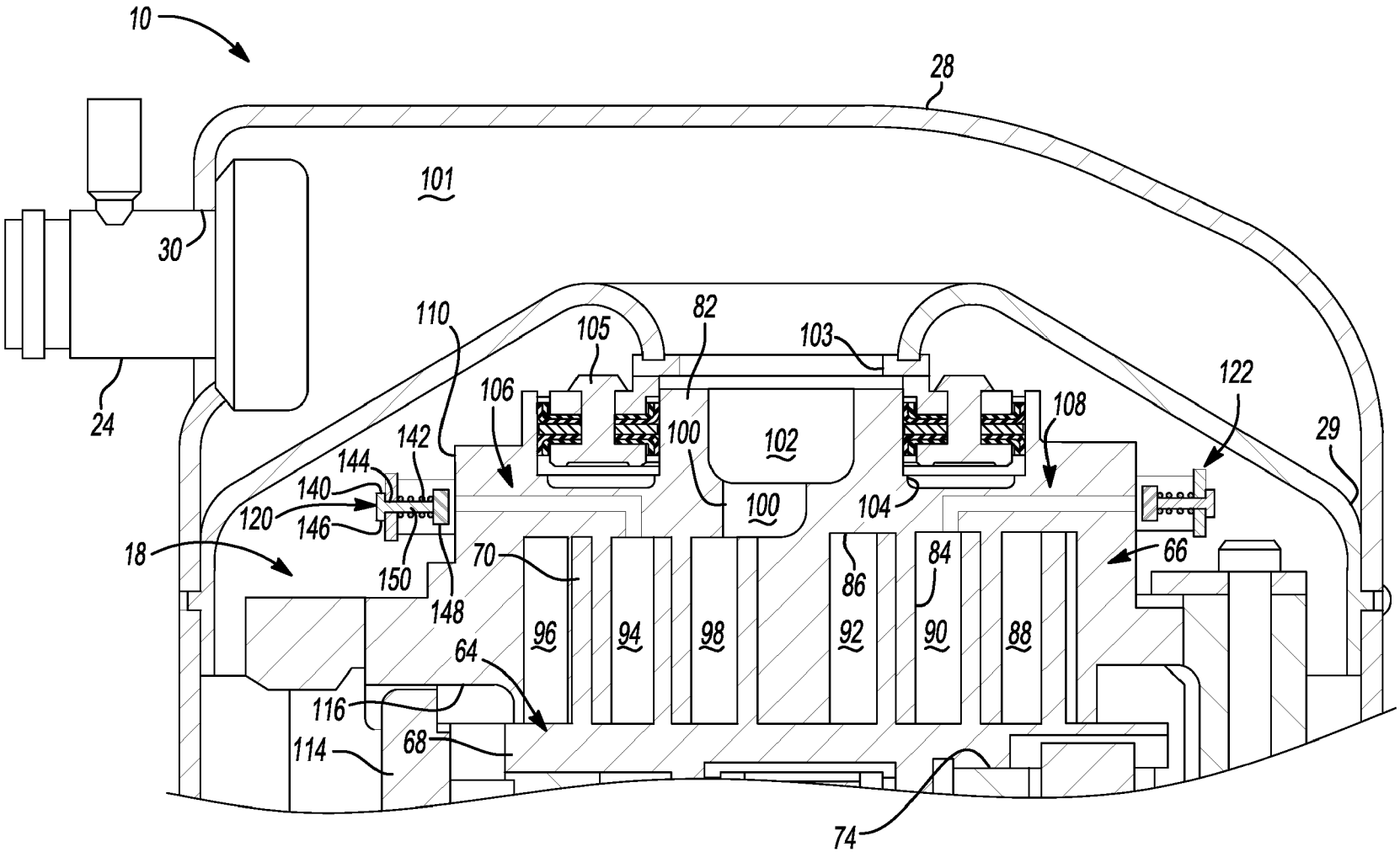
FIG. 3 is an additional fragmentary section view of the compressor of FIG. 1.

With reference to FIGS. 1-3, compressor 10 may include a cylindrical hermetic shell 16, a compression mechanism 18, a main bearing housing 20, a motor assembly 22, a refrigerant discharge fitting 24, and a suction gas inlet fitting 26. The hermetic shell 16 may house the compression mechanism 18, main bearing housing 20, and motor assembly 22. Shell 16 may include an end cap 28 at the upper end thereof and a transversely extending partition 29. The refrigerant discharge fitting 24 may be attached to shell 16 at opening 30 in end cap 28. The suction gas inlet fitting 26 may be attached to shell 16 at opening 32. The compression mechanism 18 may be driven by motor assembly 22 and supported by main bearing housing 20. The main bearing housing 20 may be affixed to shell 16 at a plurality of points in any desirable manner.

The motor assembly 22 may generally include a motor 34, a frame 36 and a drive shaft 38. The motor 34 may include a motor stator 40 and a rotor 42. The motor stator 40 may be press fit into frame 36, which may in turn be press fit into shell 16. Drive shaft 38 may be rotatably driven by rotor 42. Windings 44 may pass through stator 40. Rotor 42 may be press fit on drive shaft 38. A motor protector 46 may be provided in close proximity to windings 44 so that motor protector 46 will de-energize motor 34 if windings 44 exceed their normal temperature range.

Drive shaft 38 may include an eccentric crank pin 48 having a flat 49 thereon and one or more counter-weights 50 at an upper end 52. Drive shaft 38 may include a first journal portion 53 rotatably journaled in a first bearing 54 in main bearing housing 20 and a second journal portion 55 rotatably journaled in a second bearing 56 in frame 36. Drive shaft 38 may include an oil-pumping concentric bore 58 at a lower end 60. Concentric bore 58 may communicate with a radially outwardly inclined and relatively smaller diameter bore 62 extending to the upper end 52 of drive shaft 38. The lower interior portion of shell 16 may be filled with lubricating oil. Concentric bore 58 may provide pump action in conjunction with bore 62 to distribute lubricating fluid to various portions of compressor 10.

Compression mechanism 18 may generally include first and second compression members, such as an orbiting scroll 64 and a non-orbiting scroll 66. Orbiting scroll 64 may include an end plate 68 having a spiral vane or wrap 70 on the upper surface thereof and an annular flat thrust surface 72 on the lower surface. Thrust surface 72 may interface with an annular flat thrust bearing surface 74 on an upper surface of main bearing housing 20. A cylindrical hub 76 may project downwardly from thrust surface 72 and may include a journal bearing 78 having a drive bushing 80 rotatively disposed therein. Drive bushing 80 may include an inner bore in which crank pin 48 is drivingly disposed. Crank pin flat 49 may drivingly engage a flat surface in a portion of the inner bore of drive bushing 80 to provide a radially compliant driving arrangement.

Non-orbiting scroll member 66 may include an end plate 82 having a spiral wrap 84 on lower surface 86 thereof. Spiral wrap 84 may form a meshing engagement with wrap 70 of orbiting scroll member 64, thereby creating an inlet pocket 88, intermediate pockets 90, 92, 94, 96, and outlet pocket 98. Non-orbiting scroll 66 may have a centrally disposed discharge passageway 100 in communication with outlet pocket 98 and upwardly open recess 102 which may be in fluid communication with a discharge muffler 101 via an opening 103 in partition 29. Discharge muffler 101 may be in communication with discharge fitting 24 and may be defined by end cap 28 and partition 29. End plate 82 may include passages 106, 108 extending through a surface 110 of non-orbiting scroll member 66 and into intermediate pockets 90, 94. More specifically, passages 106, 108 may extend through an outer sidewall of end plate 82 formed by surface 110. In the present example, passages 106, 108 are disposed approximately 180 degrees apart from one another.

Non-orbiting scroll member 66 may include an annular recess 104 in the upper surface thereof having parallel coaxial side walls in which an annular floating seal 105 is sealingly disposed for relative axial movement. The bottom of recess 104 may be isolated from the presence of gas under suction and discharge pressure by floating seal 105 so that it can be placed in fluid communication with a source of intermediate fluid pressure by means of a passageway (not shown). The passageway may extend into an intermediate pocket 90, 94 and may be disposed radially inwardly relative to passages 106, 108. Non-orbiting scroll member 66 may therefore be axially biased against orbiting scroll member 50 by the forces created by discharge pressure acting on the central portion of scroll member 66 and those created by intermediate fluid pressure acting on the bottom of recess 104. Various additional techniques for supporting scroll member 66 for limited axial movement may also be incorporated in compressor 10.

Relative rotation of the scroll members 64, 66 may be prevented by an Oldham coupling, which may generally include a ring 112 having a first pair of keys 114 (one of which is shown) slidably disposed in diametrically opposed slots 116 (one of which is shown) in non-orbiting scroll 66 and a second pair of keys (not shown) slidably disposed in diametrically opposed slots in orbiting scroll 64.

With additional reference to FIGS. 4-7, compressor 10 may further include a capacity modulation system 118. Capacity modulation system 118 may be rotationally fixed relative to non-orbiting scroll 66 and may include first and second seal members 120, 122 and an actuator 124.

Figure 4:
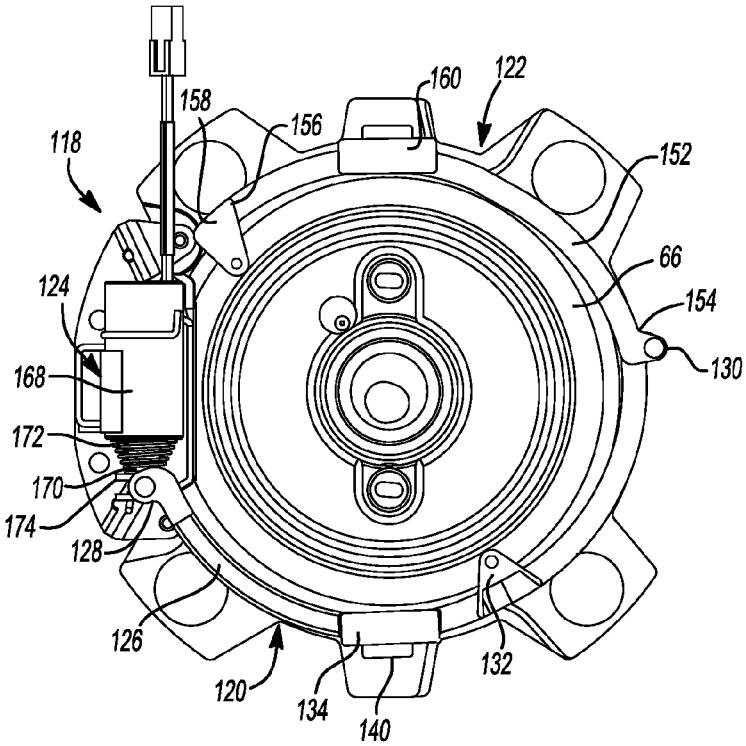
FIG. 4 is a top plan view of the non-orbiting scroll member and actuation mechanism of the compressor of FIG. 1 in a first position.
Figure 5:
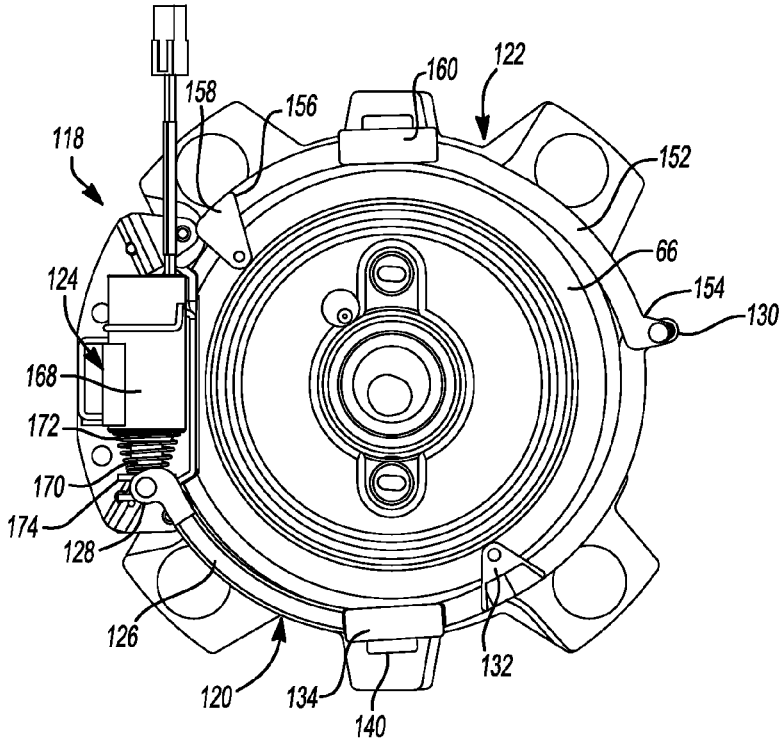
FIG. 5 is a top plan view of the non-orbiting scroll member and actuation mechanism of the compressor of FIG. 1 in a second position.
Figure 6:
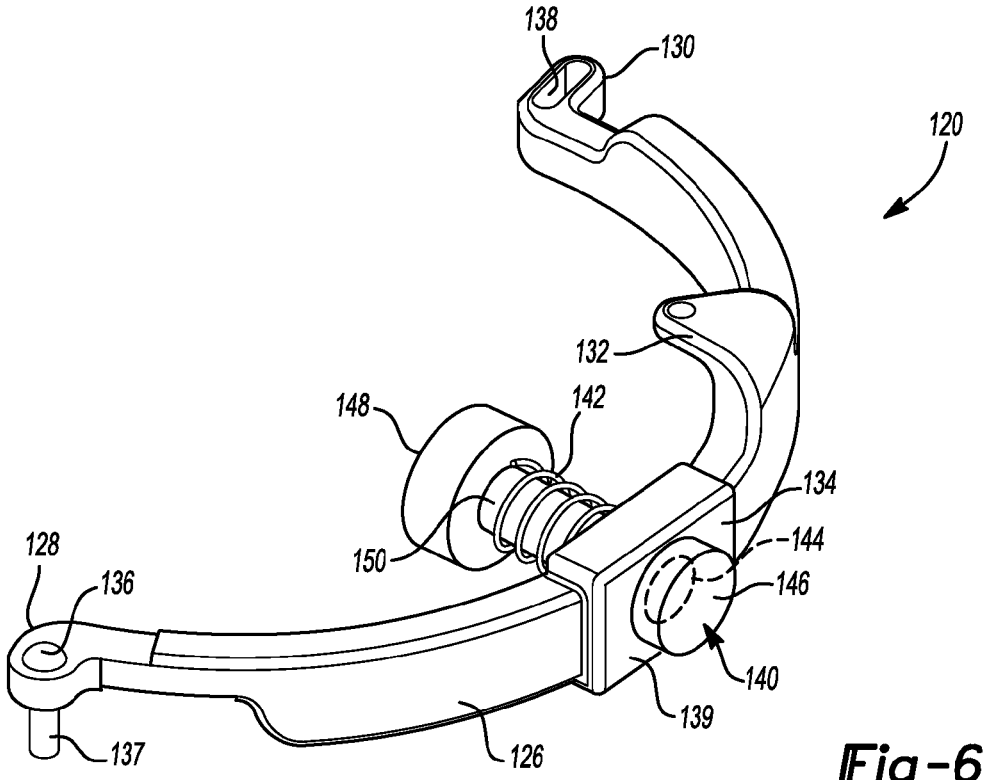
FIG. 6 is a perspective view of a first seal member of the compressor of FIG. 1.

With particular reference to FIGS. 4-6, first seal member 120 may include a generally arcuate body 126 having first and second ends 128, 130, a pivot region 132, and a sealing portion 134. First end 128 may include an aperture 136 housing a pin 137 pivotally coupled to actuator 124 and second end 130 may include an oblong slot 138 pivotally and slidably coupled to second seal member 122. Pivot region 132 may be located between first end 128 and second end 130 and may pivotally couple first seal member 120 to a rotationally fixed object. In the present example, pivot region 132 may extend radially inwardly and pivotally couple first seal member 120 to non-orbiting scroll 66.

Sealing portion 134 may be located between pivot region 132 and first end 128 and may include a body portion 139, a seal element 140, and a biasing member 142 (seen in FIGS. 2 and 3). Body portion 139 may be fixed to and generally integral with arcuate body 126 and may include an aperture 144 extending radially therethrough. With particular reference to FIGS. 2, 3, and 6, seal element 140 may include first and second ends 146, 148 and an intermediate portion 150 disposed therebetween. Intermediate portion 150 may have a diameter generally similar to the diameter of aperture 144 and may be slidably disposed therein. First and second ends 146, 148 may have diameters larger than the diameter of aperture 144. First end 146 and intermediate portion 150 may be in the form of a bolt. Second end 148 may be in the form of a sealing member and may be fixed to intermediate portion 150. As such, second end 148 may be formed from a variety of sealing materials such as elastomers. Biasing member 142 may be in the form of a spring disposed between body portion 139 and seal element 140, generally urging seal element 140 radially inwardly and into engagement with non-orbiting scroll 66.

Figure 7:
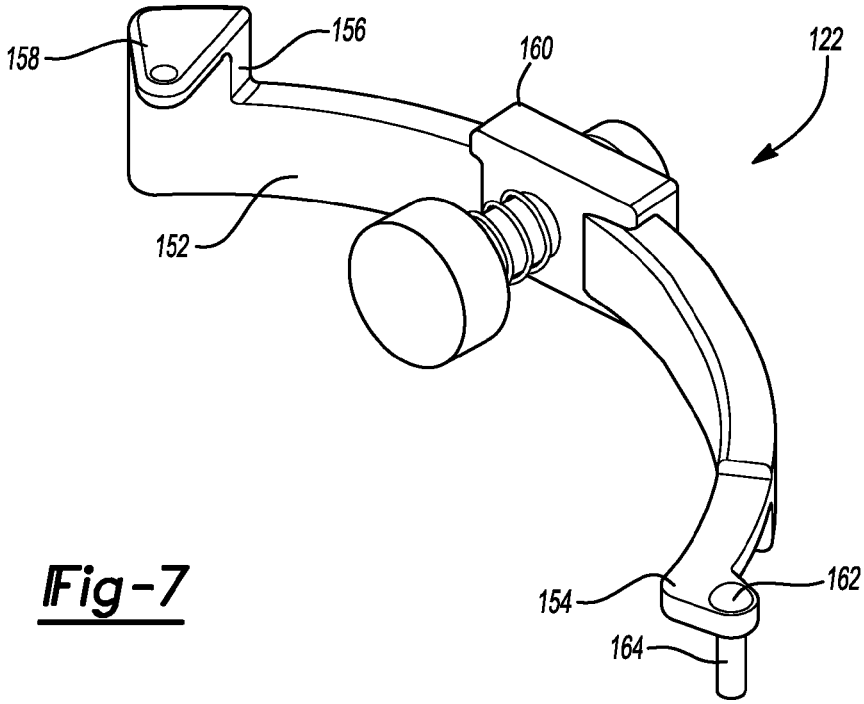
FIG. 7 is a perspective view of a second seal member of the compressor of FIG. 1.

With reference to FIGS. 4, 5, and 7, second seal member 122 may include a generally arcuate body 152 having first and second ends 154, 156, a pivot region 158, and a sealing portion 160. First end 154 may include an aperture 162 having a pin 164 extending therethrough and coupled thereto. Pin 164 may be pressed into aperture 162 and extend into oblong slot 138 in first seal member 120. Second end 156 may include a pivot region 166 pivotally coupling second seal member 122 to a rotationally fixed objected. In the present example, pivot region 158 may extend radially inward and pivotally couple second seal member 122 to non-orbiting scroll 66.

Sealing portion 160 may be disposed between first end 154 and second end 156 and may be generally similar to sealing portion 134. For simplicity, sealing portion 160 will not be described in detail with the understanding that the description of sealing portion 134 applies equally to sealing portion 160.

With particular reference to FIGS. 4 and 5, actuator 124 may include an actuation mechanism 168, such as a solenoid that is powered electrically, an actuation arm 170, and a biasing member 172. Actuation arm 170 may include a first end 174 extending from actuator 168 and pivotally coupled to first seal member first end 128. Biasing member 172 may extend between actuator arm first end 174 and actuator 168 and may provide a force generally biasing actuation arm 170 away from actuator 168, urging first seal member sealing portion 134 out of engagement with non-orbiting scroll 66. Alternatively, biasing member 172 may be removed from actuator 124. Actuator 168 may linearly displace actuation arm 170 generally inwardly therefrom.

Sealing portions 134, 160 may be located around non-orbiting scroll surface 110 proximate passages 106, 108. Each of first and second seal members 120, 122 may have an inner surface with a radius of curvature generally greater than the radius of curvature of non-orbiting scroll surface 110, generally providing for the pivotal displacement of first and second sealing members 120, 122 discussed below.

In operation, when capacity modulation is desired, actuation mechanism 168 may provide for linear displacement of actuation arm 170. More specifically, where actuation mechanism 168 is a solenoid it may be de-energized, allowing linear displacement of actuation arm 170 by biasing member 172. Displacement of actuation arm 170 may cause displacement of first seal member first end 128 in a direction that has both radially outward and tangential components relative to non-orbiting scroll member 66. Alternatively, where there is no biasing member 172 in actuator 124, biasing member 142 may cause displacement of first seal member first end 128 when actuation mechanism 168 is de-energized. Displacement of first seal member first end 128 may cause rotation of first seal member 120 about pivot region 132, thereby displacing sealing portion 134 from a first position (seen in FIGS. 2 and 4) where first sealing portion 134 seals passage 106 to a second position (seen in FIGS. 3 and 5) radially outward from the first position where passage 106 is unsealed. The second position may correspond to sealing portion 134 being located radially outwardly from surface 110 relative to the first position. As first seal member 120 is rotated, first seal member second end 130 is displaced in a direction that has radially inward and tangential components relative to non-orbiting scroll member 66.

Due to the pivotal and slidable engagement between first seal member second end 130 and second seal member first end 154, rotation of first seal member 120 may cause rotation of second seal member 122. More specifically, first seal member second end 130 may cause displacement of second seal member first end 154, resulting in rotation of second seal member 122 about pivot region 158. The displacement of second seal member first end 154 may have both radially outward and tangential components relative to non-orbiting scroll member 66. Upon rotation of second seal member 122, sealing portion 160 may be displaced from a first position (seen in FIGS. 2 and 4) where sealing portion 160 seals passage 108 to a second position (seen in FIGS. 3 and 5) radially outward from the first position where passage 108 is unsealed. The second position may correspond to sealing portion 160 being located radially outwardly from surface 110 relative to the first position.

What is claimed is:

1. A compressor comprising:

a shell;

a compression mechanism contained within said shell and including a compression member supported within said shell, said compression member including a passage extending radially through a radially outer surface of said compression member; and a sealing apparatus contained within said shell and including a first seal member and an actuator, said first seal member including a pivot region that pivotally couples said first seal member to a structure contained within said shell that is rotationally fixed relative said compression member, said pivot region fixing said first seal member from rotation about said radially outer surface, said first seal member being movable from a first position wherein a sealing portion of said first seal member is in a sealing engagement with said surface, generally preventing a fluid flow through said passage, and a second position wherein said sealing portion of said first seal member is displaced radially outwardly from said surface, generally allowing fluid flow through said passage, said actuator engaged with said first seal member and configured to selectively displace said first seal member between said first and second positions.

2. The compressor of claim 1, wherein said passage is in communication with a suction gas contained within said shell when said first seal member is in said second position.

3. The compressor of claim 1, wherein said first seal member includes a generally arcuate shape.

4. The compressor of claim 3, wherein said first seal member is engaged with said actuator at a first end portion.

5. The compressor of claim 4, wherein said first seal member includes a pivot that pivotally couples said first seal member to the structure contained within said shell that is rotationally fixed relative said compression member.

6. The compressor of claim 5, wherein said first seal member is pivotally coupled to said compression member.

7. The compressor of claim 4, wherein said first seal member first end portion is displaced radially outwardly from said compression member when said first seal member is in said second position.

8. The compressor of claim 7, wherein said first seal member includes a second end portion displaced radially inwardly from said compression member when said first seal member is in said second position.

9. The compressor of claim 7, wherein said compression member includes a second passage extending radially therethrough, said sealing apparatus including a second seal member pivotally engaged with said first seal member and movable between a third position wherein a sealing portion of said second seal member is in a sealing engagement with said surface, generally preventing a fluid flow through said second passage, and a fourth position wherein said sealing portion of said second seal member is displaced radially outwardly from said surface, generally allowing fluid flow through said passage.

10. The compressor of claim 9, wherein said second seal member includes a first end portion pivotally engaged with said second end portion of said first seal member and a second end portion pivotally supported relative said compression member, said second seal member sealing portion disposed between said first and second end portions of said second seal member.

11. The compressor of claim 9, wherein said second seal member first end portion is slidably engaged with said first seal member second end portion.

12. The compressor of claim 9, wherein said second seal member includes a radius of curvature greater than a radius of curvature of said surface.

13. The compressor of claim 1, wherein said first seal member includes a radius of curvature greater than a radius of curvature of said surface.

14. The compressor of claim 1, wherein said sealing portion includes a sealing element slidably coupled thereto.

15. The compressor of claim 14, wherein said sealing portion includes a biasing member urging said sealing element in a direction toward said compression member.

16. The compressor of claim 15, wherein said biasing member includes a spring.

17. The compressor of claim 1, wherein said compression mechanism includes an orbiting scroll meshingly engaged with a non-orbiting scroll forming a compression chamber therebetween, said passage extending into said compression chamber.

18. The compressor of claim 17, wherein said compression member includes said non-orbiting scroll.

19. The compressor of claim 17, wherein said compression chamber is an intermediate chamber at a pressure between suction and discharge pressure.

20. The compressor of claim 1, wherein said actuator includes a biasing member urging said first seal member into said second position.

21. The compressor of claim 1, wherein said actuator is powered electrically.

22. A scroll compressor comprising:

a shell;

a compression mechanism contained within said shell and including a scroll member supported within said shell, said scroll member including first and second passages extending radially through a radially outer surface of said scroll member;

a first seal member contained within said shell and pivotally supported relative said scroll member and movable from a first position wherein a sealing portion of said first seal member is in a sealing engagement with said surface, generally preventing a fluid flow through said first passage, and a second position wherein said sealing portion of said first seal member is displaced radially outwardly from said surface, generally allowing fluid flow through said first passage;

a second seal member contained within said shell and pivotally coupled to said first seal member and movable from a third position wherein a sealing portion of said second seal member is in a sealing engagement with said surface, generally preventing a fluid flow through said second passage, and a fourth position wherein said sealing portion of said second seal member is displaced radially outwardly from said surface, generally allowing fluid flow through said second passage; and an actuator engaged with said first seal member and configured to selectively displace said first seal member between said first and second positions.

23. The scroll compressor of claim 22, wherein said first seal member includes first and second portions and a sealing portion disposed therebetween, said second seal member including first and second portions and a sealing portion disposed therebetween, said first seal member first portion pivotally supported relative said scroll member, said second seal member first portion pivotally coupled to said first seal member second portion.

24. The scroll compressor of claim 23, wherein said first seal member first portion is pivotally coupled to said actuator.

25. The scroll compressor of claim 23, wherein said first seal member second portion is displaced radially inward toward said scroll member when moved from said first position to said second position.

26. The scroll compressor of claim 23, wherein said second seal member first portion is displaced radially outward from said scroll member when moved from said third position to said fourth position.

27. The scroll compressor of claim 23, wherein said second seal member first portion is slidably coupled to said first seal member second portion.

28. The scroll compressor of claim 22, wherein said actuator is powered electrically.

29. The compressor of claim 22, wherein said scroll member is a non-orbiting scroll member.

* * * * *